US007056145B2

(12) United States Patent
Campbell, III et al.

(10) Patent No.: US 7,056,145 B2
(45) Date of Patent: Jun. 6, 2006

(54) PLUG SECURING AND OUTLET COVER DEVICE

(76) Inventors: Richard G. Campbell, III, 502 W. Mertz Rd., Perris, CA (US) 92570; Richard Campbell, Sr., 502 W. Mertz Rd., Perris, CA (US) 92570

( * ) Notice: Subject to any disclaimer, the term of this patent is extended or adjusted under 35 U.S.C. 154(b) by 0 days.

(21) Appl. No.: 10/800,080

(22) Filed: Mar. 12, 2004

(65) Prior Publication Data

US 2005/0202709 A1 Sep. 15, 2005

(51) Int. Cl.
*H01R 13/62* (2006.01)

(52) U.S. Cl. ..... 439/373; 439/135; 174/67

(58) Field of Classification Search ..... 439/373, 439/369, 147, 135, 136, 140; 174/67
See application file for complete search history.

(56) References Cited

U.S. PATENT DOCUMENTS 2,526,606 A * 10/1950 Gregg ..... 174/67
3,491,327 A * 1/1970 Goldwater, Jr. et al. .... 439/135
4,851,612 A * 7/1989 Peckham ..... 174/67
4,915,638 A * 4/1990 Domian ..... 439/142
5,045,640 A * 9/1991 Riceman ..... 174/67
5,195,901 A * 3/1993 Correnti ..... 439/147
5,218,169 A * 6/1993 Riceman ..... 174/67
5,655,924 A * 8/1997 Cross et al. ..... 439/373
5,703,329 A * 12/1997 Delone ..... 174/67
5,997,318 A * 12/1999 Chou ..... 439/136
6,428,333 B1 * 8/2002 Rust ..... 439/140
6,552,269 B1 * 4/2003 Conner ..... 174/67
6,769,930 B1 * 8/2004 McDevitt, Jr. ..... 439/373

* cited by examiner

*Primary Examiner*—Tho D. Ta
(74) *Attorney, Agent, or Firm*—Kirk A Buhler; Buhler & Associates

(57) ABSTRACT

A plug securing device that allows improved retention of an electrical cord in an electrical outlet. The plug securing device consists of a replacement electrical outlet cover, and a plug securing device. The plug from a power cord is placed through a slot in the plug securing device, and the plug and plug securing device is placed into the outlet and the replacement electrical outlet cover. The plug securing device is removed and the plug disconnected from the outlet when the user pressed the plug securing device into the replacement electrical cover and presses in on the sides of the plug securing device. The invention allows for a child and or paint cover that engages in the electrical cover and covers the entire electrical outlet and replacement electrical outlet cover.

10 Claims, 3 Drawing Sheets

PLUG SECURING AND OUTLET COVER DEVICE

FIELD OF THE INVENTION

The field of the invention is an electrical cord retaining and safety device. More specifically, the outlet cover of an electrical outlet is replaced with an outlet cover with rectangular holes. A plug-securing device is placed over the electrical plug, and when the plug is installed in the electrical outlet, the plug-securing device snaps into the electrical outlet cover and secures the plug from accidental removal unless the locking tabs that snap into the electrical outlet cover are depressed. A child and or paint cover can be used with the electrical cover to cover the entire electrical outlet and replacement electrical outlet cover.

BACKGROUND OF THE INVENTION

Many electrical cord securing devises have been invented that help to secure an electrical plug in an electrical outlet. Most of these inventions require the user to twist or turn the locking device to release the plug-securing device. Other inventions require the user to screw cord-securing devices into the electrical outlet. Still other inventions require that the cord-retaining device must be wrapped around the cord or outlet cover.

U.S. Pat. Nos. 6,196,859, 5,989,052, D475,352, 4,457,571 disclose a power cord retaining mechanism that consists of an electrical outlet cover, and a secondary power cord retaining component that is placed over the power cord. After the secondary power cord-retaining component is placed over the power cord the secondary power cord retaining component is located near the electrical outlet cover, and rotated to lock the power cord and the secondary power cord-retaining component into the wall. To release the power cord the user must rotate the secondary power cord-retaining component. While these inventions perform the basic task of retaining the power cord, they make it difficult to remove the power cord, and are not a simple as depressing the sides of the secondary power cord-retaining component to remove the power cord.

U.S. Pat. Nos. 5,927,023, 5,575,677 disclose a telescoping cord retainer where the plug retention device is locked inside a secondary housing. A replacement outlet cover is first installed onto the receptacle. The power cord plug is placed within a secondary power cord-retaining component. The plug is plugged into the outlet, and then the secondary power cord-retaining component is slid or telescoped into the replacement outlet cover. To remove the power cord the user needs to slide a screwdriver or similar tool into the secondary power cord-retaining component to release the secondary power cord retaining component from the replacement outlet cover. There are two problems with this invention. First, the replacement outlet cover extends beyond the surface of a standard outlet cover, and secondly the power cord is not simple to remove.

U.S. Pat. No. 4,789,353 discloses a cord retainer that screws into a replacement electrical cover. Power cords are placed into semi-circular members that screw down around the power cord and retain the power cord in place. To remove the power cord the user must rotate the semi-circular member until the power cord can be removed. The problem with this type of design is that the semi-circular member may be accidentally rotated. In addition, the replacement electrical cover extends beyond the surface of a standard outlet cover.

U.S. Pat. Nos. 5,375,728 and Des 360,878 disclose a covering device for an electrical outlet where the cover includes tabs that engage into the electrical outlet. These patents protect a child from placing an object into the electrical outlet. A potential problem with this configuration of electrical outlet cover is that the tabs that engage into the electrical outlet could break off and prevent future usage of the outlet. While these patents protect a child form placing an object into an electrical outlet, the retention mechanism engages into the electrical outlet, and may spread or damage the contacts located in the outlet. These patents do not allow the cover to be retained by something other than the outlet itself.

What is needed is a simplified plug-securing device that requires the user to push the power cord and power cord-retaining device into the outlet in a single motion and remove the power cord by simply squeezing the plug-securing device. In addition, the ideal design would not extend from the wall beyond the point a standard outlet cover would extend.

BRIEF SUMMARY OF THE INVENTION

It is an objective of the present invention to provide a superior electrical cord-securing device to secure a power cord in an electrical outlet. The superior user interface should include both an easy installation and easy removal of the electrical cord. These superior features should reduce the possibility of accidental removal of the electrical cord. Additional benefits of the invention should be the improved safety of the electrical cord and the improved safety from children using the electrical outlet.

The invention consists of two basic components. The first component is a replacement electrical outlet cover. The outlet cover is similar size and shape in comparison to an outlet cover that would normally cover the wiring on an electrical outlet and allow the connection point for an electrical plug to be connected. The difference between a standard electrical cover and the replacement cover is that the replacement cover has holes located on the sides of the electrical plug connection point. The holes on the sides of the electrical plug connection point have louvered holes to protect the wiring behind the replacement electrical cover. The second component consists of a hollow block shaped plug retainer that accepts a standard electrical cord and plug. The plug retainer has a slot down one side that allows the cord to be routed through the plug retainer. The plug retainer also has tabs located on the bottom edge of the retainer. These tabs are designed to lock the plug retainer into the replacement outlet cover. Once the two components are locked together they can only be released when the user pushes the plug retainer further into the replacement electrical cover and the squeezes in on the sides of the plug retainer.

Additional components, such as spacers, can be added that allow the plug-securing device to operate with a variety of different electrical plugs and electrical cords to ensure the plug is securely connected.

The invention provides a simplified and secure method of ensuring the plug can be held in an electrical outlet without accidental removal or unplugging, and provides a simple plug removal process when the user needs to unplug the power cord.

In addition to using the securing mechanism to retain an electrical cord, the securing mechanism may be used to secure a concave cover that surrounds the outlet and replacement electrical outlet cover. The concave cover can protect the electrical outlet from children and may be painted or wall papered to match a wall. The concave cover may further include features that allow easier removal of the cover.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
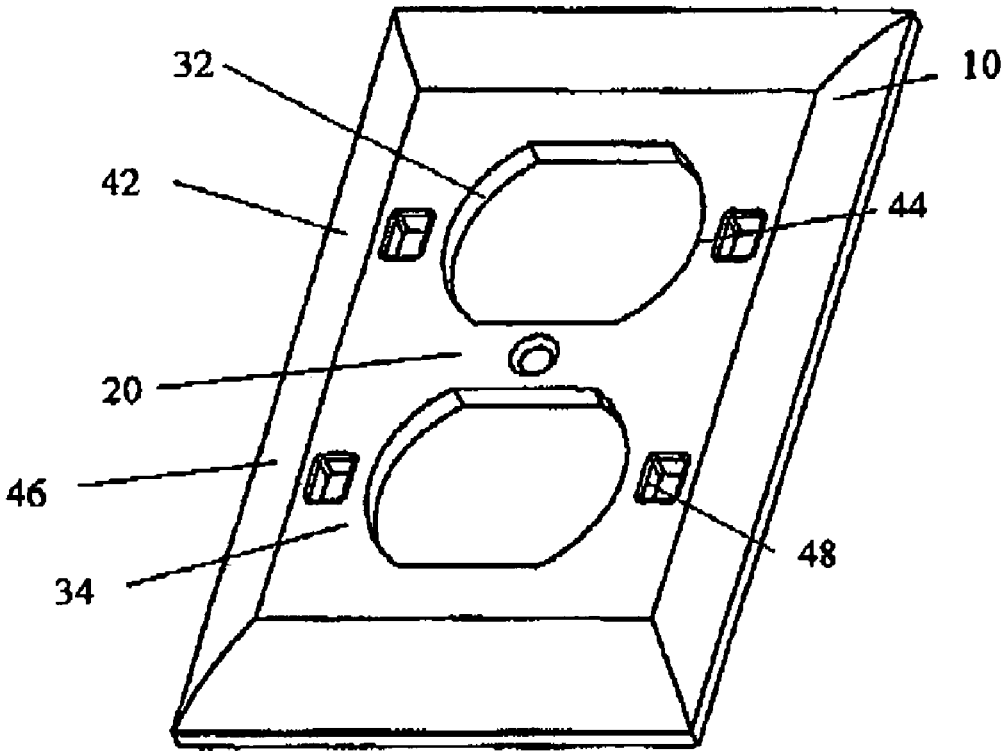
FIG. 1 is an isometric view of the replacement outlet cover

Referring first to FIG. 1, that shows an isometric view of the replacement outlet cover, item 10. The replacement outlet cover is about the same size and shape as a standard outlet cover. The size is about 2.75 inches wide, 4.4 inches tall and 0.25 inches tall. While specific dimensions of the replacement outlet cover have been given, larger or smaller sizes are contemplated. In addition to a rectangular shape, the replacement cover could be circular in shape, or may include the image of cartoon characters, or other information that identifies that the replacement cover is operated by a specific circuit breaker or switch. The replacement outlet cover may have safety or operating instructions printed on the cover to aid using the invention. The size and shape of the replacement outlet cover can be configured as shown in the FIG. 1, where a single screw goes through the hole, item 20 and retains the outlet cover to a wall. In the configuration shown two openings, items 32 and 34, allow the electrical outlets to extend though the replacement outlet cover and terminate at the face of the replacement electrical outlet cover. The replacement outlet cover configures where a single rectangular opening that encompasses both outlets. In the single rectangular opening the outlet cover is attached to a wall with two screws, one located above the outlets, and one located below the outlets. The replacement outlet cover may be made from a variety of materials including plastics such as ABS, PVC, polycarbonate, or other material. The color of the replacement cover can be white, beige or any color that would blend with the wall or may contrast or color to a wall. The method of manufacturing may be from molding, machining, stamping, bending or forming. The ideal material would satisfy construction, and electrical code requirements. The preferred embodiment is to mold the replacement cover with one opening for each electrical receptacle in a flame retardant material. Items 42, 44, 46, and 48 are rectangular openings that exist on the sides of each electrical receptacle where the plug retainer is located.

Figure 2:
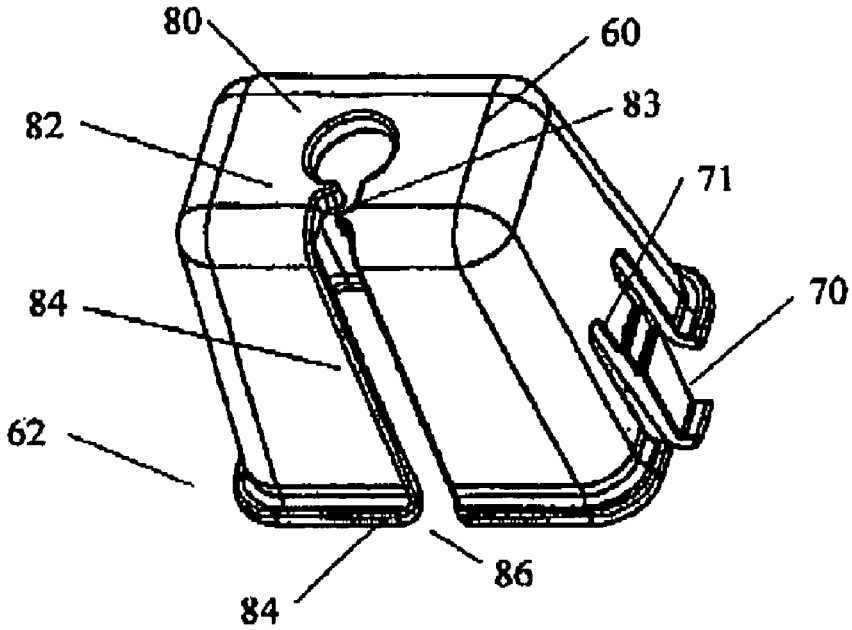
FIG. 2 is an isometric view of the plug retainer

Refer now to FIG. 2 showing an isometric view of the plug retainer, item 60. The plug retainer may be made from a variety of materials including plastics such as ABS, PVC, polycarbonate, or other material. The color of the plug retainer can be white, beige or any color that would blend or contrast with the replacement outlet cover. The method of manufacturing may be from molding, machining, stamping, bending or forming. The ideal material would satisfy construction, and electrical code requirements. The preferred embodiment is to mold the plug retainer in the configuration shown in FIG. 2 in a flame retardant material. Item 70 one of the two locking tabs that lock into item 42, 44, 46 or 48 in the replacement outlet cover. There is an identical tab to item 70 located on the other side of the plug retainer such that the part can be locked into the replacement cover in the orientation shown, or rotated 180 degrees from the orientation shown. Item 71, is details located on the tabs to allow the user to grip the sides of the plug retainer more easily. In the preferred embodiment, the detail(s) 71 are raised from the sides of the tabs, but these details can be recessed or may be a textured area on the sides of the tabs. Item 80, is a hole that exists on the back of the plug retainer. This hole is the opening where the cord of a plug exits the plug retainer. Items 82 and 83 are raised areas of the plug retainer that keep the power cord from sliding out of the plug retainer. Item 84, is a slot that runs from the base of the plug retainer, item 62 to hole in the back of the plug retainer, item 80. The slot allows the user to insert a cord through the plug retainer. The slot also allows the user to remove the cord and plug from the plug retainer. Item 62, is a lip that exists around the perimeter of the base of the plug retainer. This lip improves the stability of the part then the plug retainer is connected to the replacement outlet cover. When a user presses in on tabs 70, the user is prevented from collapsing the plug retainer because edges 84 and 86 make contact with each other to prevent further collapsing of the plug retainer.

Figure 3:
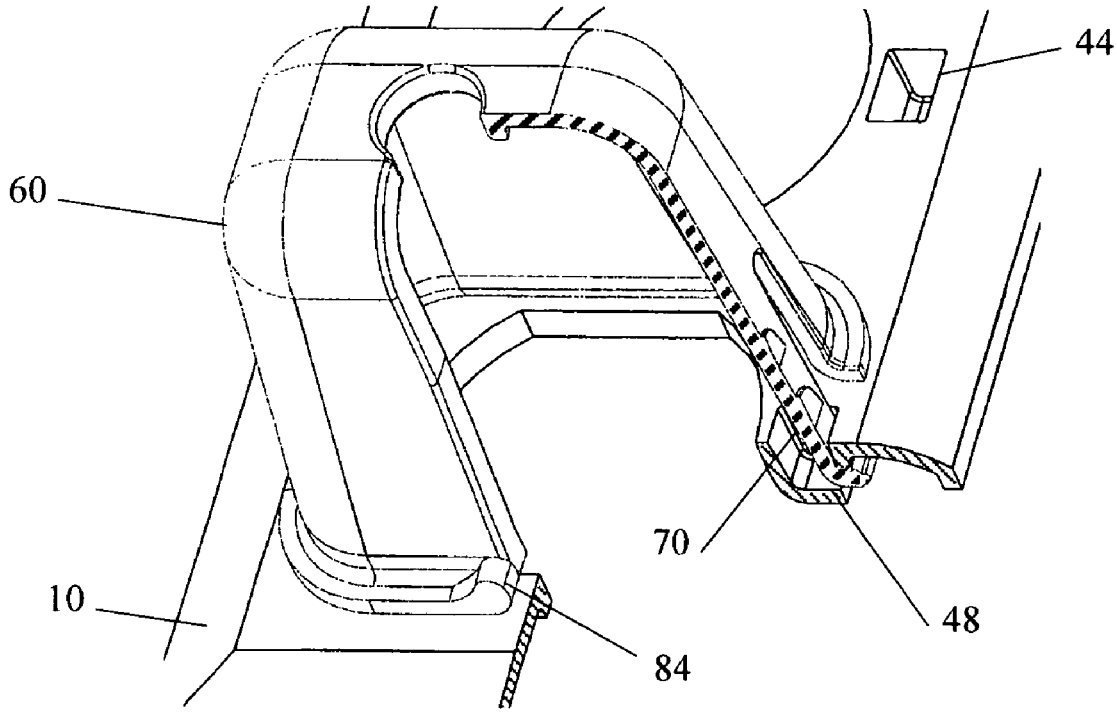
FIG. 3 is detailed view plug retainer connected into the replacement outlet cover.
Figure 4:
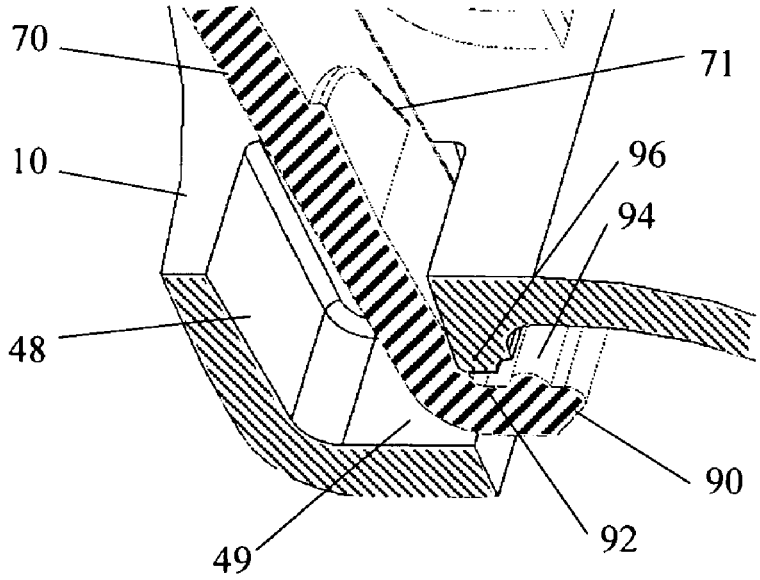
FIG. 4 is a detailed view of the engagement of the plug retainer and the replacement outlet cover.

FIG. 3 is detailed view of the plug retainer connected into the replacement outlet cover. From this view, tab 70 is shown locked into rectangular opening 48. Refer now to FIG. 4 showing a detailed view of the engagement of the plug retainer and the replacement outlet cover. In this figure item 94 is a vertical tab located at the end of locking tab 70 on the plug retainer. This vertical tab is shown locked under tab 96 that extend down from the underside of the replacement outlet cover. Tab 96 rests in a grove, item 92 that is formed in tab 70 of the plug retainer. Item 49, is a louver tab that extends from item replacement electrical cover that shields the electrical wiring. This louver tab reduces the possibility that someone accidental places an object into the rectangular hole that may touch one or more of the electrical connections within the electrical box. In this drawing it can be seen that in order to remove the plug retainer from the replacement outlet cover the user must first press down on the plug retainer to lower tab 94 to a position that is under tab 96 on the replacement outlet cover. Once tab 94 is under tab 96, the user can then squeeze tab 70 and bring the end of tab 90 into the rectangular opening 48. At this point the plug retainer can be lifted clear of the replacement outlet cover. When the plug retainer is being inserted into the replacement outlet cover the reverse action must be performed where the user must push the plug retainer down far enough into the replacement outlet cover such that tabs 96 and 94 can pass each other and lock the plug retainer into the replacement outlet cover.

Figure 5:
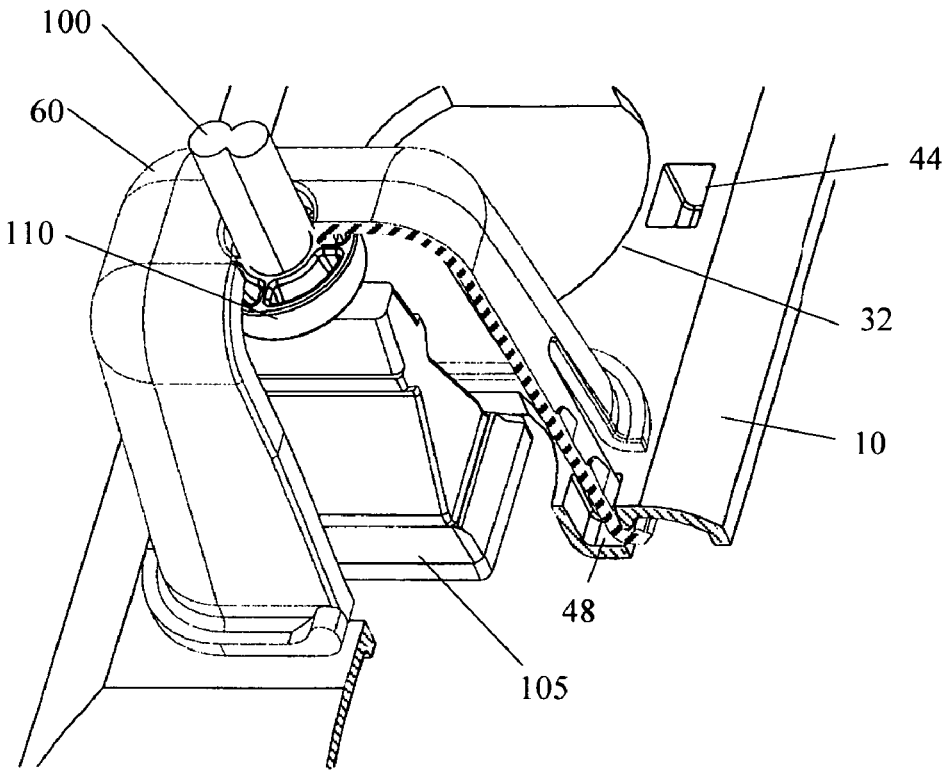
FIG. 5 is a cut away view of a plug installed in an electrical outlet using a plug spacer.

Refer now to FIG. 5 showing a cut away view of a plug installed in an electrical outlet using a plug spacer. In this figure, a plug, item 105 is shown that does not fill the entire height of the plug retainer. In this embodiment a spacer, item 110 is slid around the power cord, item 100, and is placed on top of the plug. The space ensures that when the plug retainer is connected to the replacement outlet cover the plug cannot be unplugged if the user pulls on the power cord. The spacer may be made from a variety of materials including plastics such as ABS, PVC, polycarbonate, or other material. The color of the spacer can be white, beige or any color that would match or contrast the other parts of the invention. The method of manufacturing may be from molding, machining, stamping, bending or forming. The ideal material would satisfy construction, and electrical code requirements. The preferred embodiment is to mold the spacer in the configuration shown in FIG. 5 in a flame retardant material.

Thus, specific embodiments and applications of the plug securing invention have been disclosed. It should be apparent, however, to those skilled in the art that many more modifications besides those described are possible without departing from the inventive concepts herein. For example, the invention may include one fixed tab located on one side of the plug retainer, and one moveable tab that can be engaged or disengaged into the replacement outlet cover. The inventive subject matter, therefore, is not to be restricted except in the spirit of the appended claims.

Figure 6:
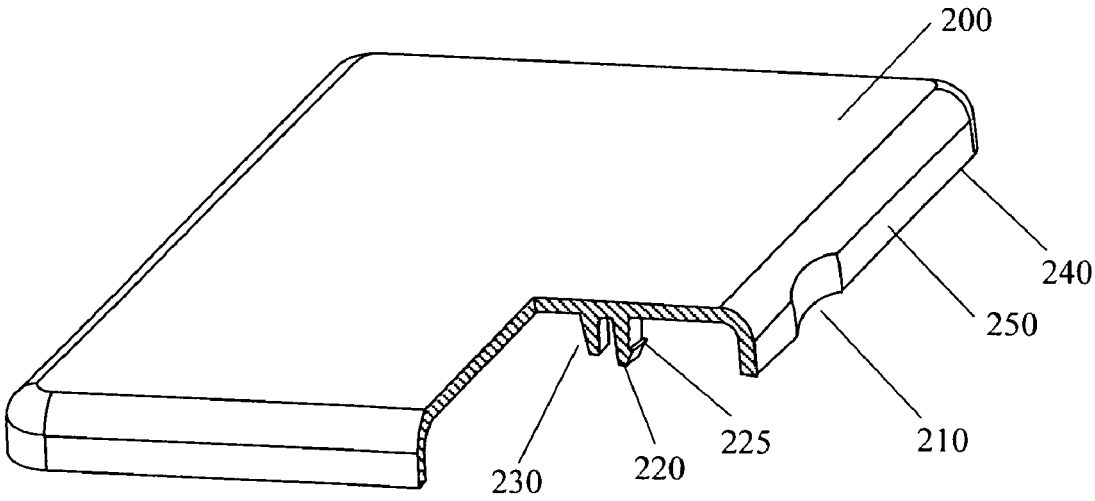
FIG. 6 is a cut away view of an outlet and paint cover for the replacement electrical cover.

FIG. 6 is a cut away view of an outlet and paint cover for the replacement electrical cover. Item 200 is a concave shaped cover. The concave cover includes a raised wall, item 250, and a lip, item 240 that extends around the entire part. This lip raises the concave cover to allow clearance for the replacement electrical cover and the electrical outlet. The lip seals the concave cover against a wall to block objects from being placed into the electrical outlet. The concave cover provides a continuous cover around the outlet and replacement electrical cover so the concave cover may be painted, wall papered or finished in some other manner to match the wall. The wall may include an area, item 210 that allows a user to grasp the walls of the concave cover to assist in removal of the concave cover from the replacement electrical outlet cover. On the underside of the concave cover tab 220 extends vertically from the top of the cover. On the end of the tab a hook, item 225 extends from the tab. When the concave cover is located over the replacement electrical cover, the tab can be inserted into the rectangular hole(s) of the replacement electrical outlet cover, and the hook(s) locks under tab 94 of the replacement electrical cover. A second tab, item 230 may be optionally included that applies pressure to the opposite side of the rectangular hole(s) to further improve retention of the concave cover. The concave cover may be made from a variety of materials including plastics such as ABS, PVC, polycarbonate, or other material. The color of the concave cover can be white, beige or any color that would match or contrast the other parts of the invention. The method of manufacturing may be from molding, machining, stamping, bending or forming. The ideal material would satisfy construction, and electrical code requirements. The preferred embodiment is to mold the concave cover in the configuration shown in FIG. 6 in a flame retardant material.

Thus, specific embodiments and applications of the plug securing and outlet cover invention have been disclosed. It should be apparent, however, to those skilled in the art that many more modifications besides those described are possible without departing from the inventive concepts herein. For example, the invention may include one fixed tab located on one side of the plug retainer, and one moveable tab that can be engaged or disengaged into the replacement outlet cover. The inventive subject matter, therefore, is not to be restricted except in the spirit of the appended claims.

What is claimed is:

1. An electrical cord securing device comprising:

a replacement outlet cover configured with at least one hole located on opposite sides of an outlet wherein each hole has at least one louvered tab to prevent objects from being passes through the hole;

a plug retainer comprising: an elongated slot extending the length of the plug retainer for passage of an electrical cord; and locking tabs on the sides of the plug retainer:

wherein the plug retainer surrounds at least a portion of the electrical cord; and wherein the plug retainer is installed in the replacement outlet cover by pushing the locking tabs on the sides of the plug retainer into the holes in the replacement outlet cover and removed by pressing in on the locking tabs on the sides of the plug retainer to collapse the elongated slot to disengage the plug retainer from the outlet cover.

2. The electrical cord securing device from claim 1 further includes a raised area located on the book side of the holes that require the user to press the plug retainer into the outlet before the plug retainer can be removed.

3. The slot from claim 1 where the slot is capable of retaining the electrical cord.

4. The tabs from claim 1 where the tabs are shaped such that when the sides of the plug retainer are depressed the plug retainer cannot be collapsed.

5. The tabs from claim 1 further include raised, lowered or texture surface located on the sides of the tabs.

6. The electrical cord securing device from claim 1 further includes at least one spacer that can be used to further secure a power cord within the plug retainer.

7. The electrical cord securing device from claim 1 where the replacement outlet component has holes placed on opposing sides of each outlet.

8. The holes from claim 7 where the holes are rectangular.

9. The tabs from claim 1, where the tabs are rectangular.

10. The tabs from claim 9 include detents that require the user to press the sides of the plug retainer down and inward to release the plug retainer from the replacement outlet cover.

* * * * *